US005605521A

United States Patent [19]

Hsieh

[11] Patent Number: 5,605,521

[45] Date of Patent: Feb. 25, 1997

[54] STRIDING EXERCISER

[75] Inventor: Yi F. Hsieh, Succasunna, N.J.

[73] Assignee: LifeGear, Inc., Rockaway Township, N.J.

[21] Appl. No.: 602,101

[22] Filed: Feb. 15, 1996

[51] Int. Cl.[6] ..... A63B 22/00

[52] U.S. Cl. ..... 482/51; 482/52; 434/255

[58] Field of Search ..... 482/51, 52, 53, 482/54, 70, 96, 148, 74, 79; 434/255

[56] References Cited

U.S. PATENT DOCUMENTS

| | | | |
|---|---|---|---|
| 4,563,001 | 1/1986 | Terauds | 272/72 |
| 4,645,200 | 2/1987 | Hix | 272/73 |
| 4,830,362 | 5/1989 | Bull | 272/70 |
| 4,850,585 | 7/1989 | Dalebout | 272/70 |
| 4,861,023 | 8/1989 | Wedman | 272/120 |
| 4,934,690 | 6/1990 | Bull | 272/70 |
| 4,940,233 | 7/1990 | Bull et al. | 272/130 |
| 4,989,858 | 2/1991 | Young et al. | 272/70 |
| 5,000,443 | 3/1991 | Dalebout et al. | 272/70 |
| 5,016,869 | 5/1991 | Dick et al. | 272/70 |
| 5,039,088 | 8/1991 | Shifferaw | 272/73 |
| 5,054,770 | 10/1991 | Bull | 272/70 |
| 5,076,572 | 12/1991 | Wang | 272/70 |
| 5,290,211 | 3/1994 | Stearns | 482/53 |
| 5,318,490 | 6/1994 | Henderson et al. | 482/53 |
| 5,336,141 | 8/1994 | Vittone | 482/51 |
| 5,401,226 | 3/1995 | Stearns | 482/53 |
| 5,419,747 | 5/1995 | Piaget et al. | 482/51 |
| 5,423,729 | 6/1995 | Eschenbach | 482/70 |
| 5,492,518 | 2/1996 | Measom | 482/96 |

*Primary Examiner*—Stephen R. Crow
*Attorney, Agent, or Firm*—David L. Davis

[57] ABSTRACT

A striding exerciser comprising a frame having a base adapted to be supported on a horizontal surface and a pair of spaced upright supports each secured to and extending upwardly from the base. A pair of stride assemblies are each mounted to the frame and each includes a leg member and an arm member, arranged to pivot about a respective first and second pivot axis. A first mechanism is provided for interconnecting the leg member and the arm member within each stride assemblies for concurrent pivoting movement in the same angular direction about their respective pivot axes and a second mechanism is provided for interconnecting the pair of stride assemblies for concurrent pivoting movement in opposite angular directions about the pivot axes.

9 Claims, 3 Drawing Sheets

STRIDING EXERCISER

BACKGROUND OF THE INVENTION

This invention relates to exercise apparatus and, more particularly, to apparatus for effecting a non-impact aerobic workout of the user. Specifically, the type of exercise facilitated by the inventive apparatus is striding.

Non-impact aerobic workouts are known to be beneficial for cardiovascular fitness while at the same time not being deleterious to the bones and joints of the individual. While it is possible to achieve such a workout without the assistance of any apparatus, it is often inconvenient and difficult to do so. Thus, if one wanted to use walking as an exercise, since walking involves only slight impact, the ability to do so outdoors is influenced by the weather. A particularly effective type of walking is known as "striding", wherein long steps are taken with exaggerated swinging of the arms, often while holding weights in both hands. In addition to weather related problems, when performing such an exercise outdoors, uneven terrain can make the exercise difficult and can even result in injuries. It is therefore an object of the present invention to provide exercise apparatus which facilitates a striding workout that can be performed indoors.

U.S. Pat. No. 5,419,747 to Piaget et al discloses striding exercise apparatus wherein the pivot axes for the arm members are above the pivot axes for the leg members. Hydraulic cylinders are connected to the arm and leg members to provide resistance when the arm and leg members are reciprocated. This adds expense to the apparatus which, in any event, is bulky so that it is not particularly suitable for home use. It is therefore a further object of this invention to provide striding exercise apparatus of the type described which is inexpensive, which utilizes the user's own body weight as resistance to avoid the inclusion of expensive resistance elements, and which is compact so that it is suitable for home use.

U.S. Pat. No. 4,850,585 to Dalebout discloses a striding exerciser having a frame and a pair of pivoting leg members which support a user above the floor. A pair of handle members pivot about the same axis as the leg members and extend upwardly therefrom to effect a "poling" motion of the user's arms. In one embodiment, a cable mechanism is provided to force opposite rotation of the pair of leg members with respect to each other. Although the Dalebout apparatus is more compact than the Piaget et al apparatus and therefore is more suitable for home use, a disadvantage of the Dalebout apparatus is that the cable mechanism is complicated to assemble and service, in addition to increasing the cost of the apparatus. It is therefore another object of this invention to provide striding exercise apparatus for home use which is simple to assemble and service and which includes a low cost mechanism for interconnecting the arm and leg members.

SUMMARY OF THE INVENTION

The foregoing and additional objects are attained in accordance with the principles of this invention by providing exercise apparatus comprising a frame having a base adapted to be supported on a horizontal surface and a pair of spaced upright supports each secured to and extending upwardly from the base. A pair of stride assemblies are provided, each mounted to the frame and each including a leg member pivotally mounted to a respective frame support at a horizontal first pivot axis and extending below the first pivot axis between the pair of supports, a foot platform mounted to the leg member at a location below and remote from the first pivot axis and adapted to support a user thereon, an arm member pivotally mounted to the frame at a horizontal second pivot axis parallel to and spaced from the first pivot axis with the arm member extending above the second pivot axis, and a hand grip mounted to the arm member at a location above and remote from the second pivot axis. Each of the stride assemblies also includes first interconnect means for interconnecting its leg and arm members for concurrent pivoting movement in the same angular direction about their respective pivot axes. The apparatus further includes second interconnect means for interconnecting the pair of stride assemblies for concurrent pivoting movement in opposite angular directions about the pivot axes.

In accordance with an aspect of this invention, for each of the stride assemblies one of the arm and leg members includes an extension extending beyond the respective pivot axis and the first interconnect means includes a rigid link pivotally coupled to the extension and to the other of the arm and leg members.

In accordance with another aspect of this invention, the second interconnect means includes a rigid bar coupled to the arm member of one of the stride assemblies for rotation therewith about the second pivot axis with the rigid bar extending above the second pivot axis, and a rigid link pivotally coupled above the second pivot axis to the rigid bar and below the first pivot axis to the leg member of the other stride assembly.

In accordance with still another aspect of this invention, the apparatus further includes a hollow tube fixedly secured to the frame in a horizontal orientation, a shaft journalled for rotation in the tube and defining the second pivot axis, means for fixedly securing one of the arm members to the shaft at one end of the tube, and means for rotatably mounting the other of the arm members on the shaft at the other end of the tube. The second interconnect means includes a rigid bar fixedly mounted to the shaft at the other end of the tube, and a rigid link pivotally coupled above the second pivot axis to the rigid bar and below the first pivot axis to the leg member in the same stride assembly as the other arm member.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
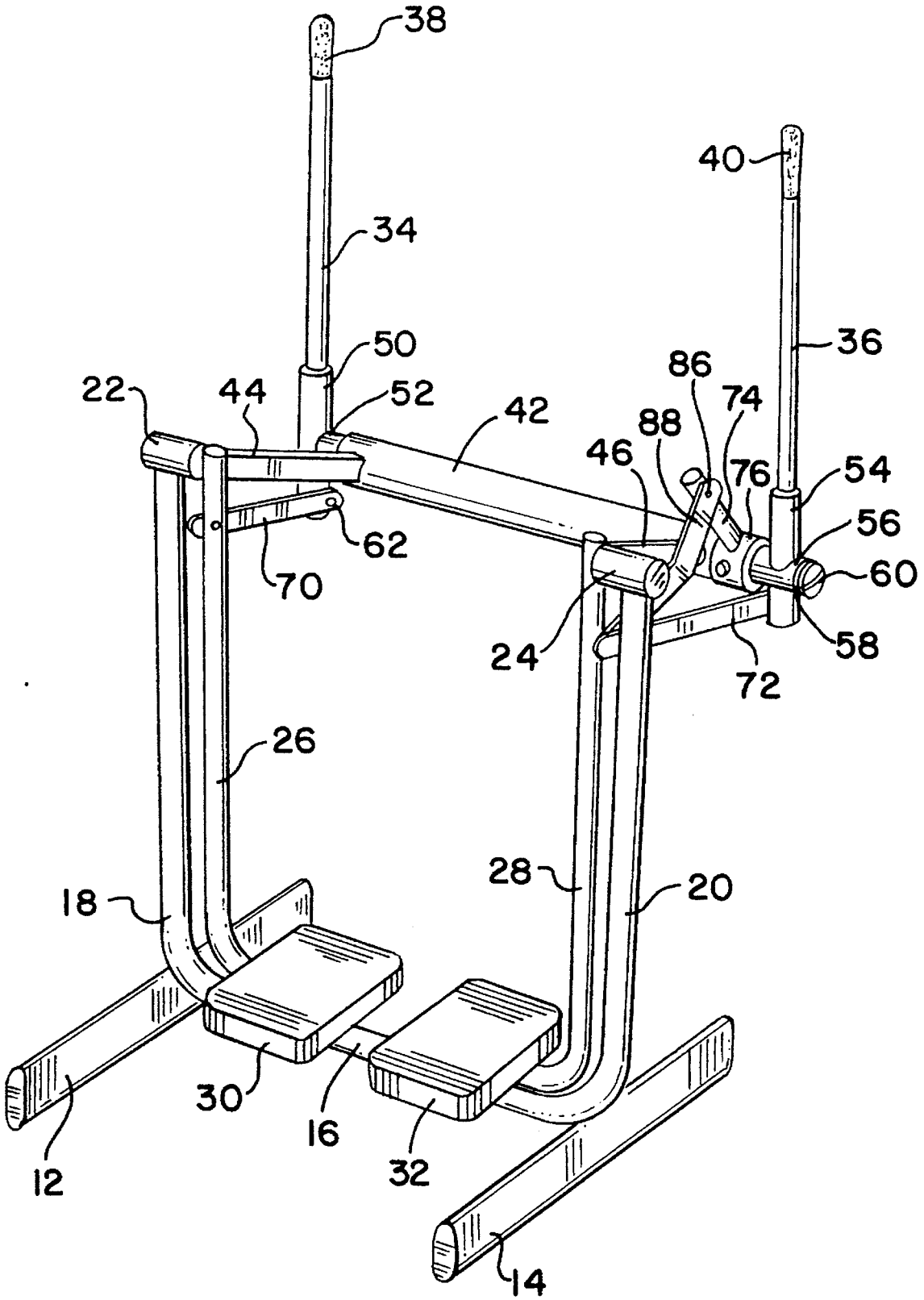
FIG. 1 is a perspective view, from the rear, of an illustrative striding exerciser constructed in accordance with the principles of this invention.
Figure 2:
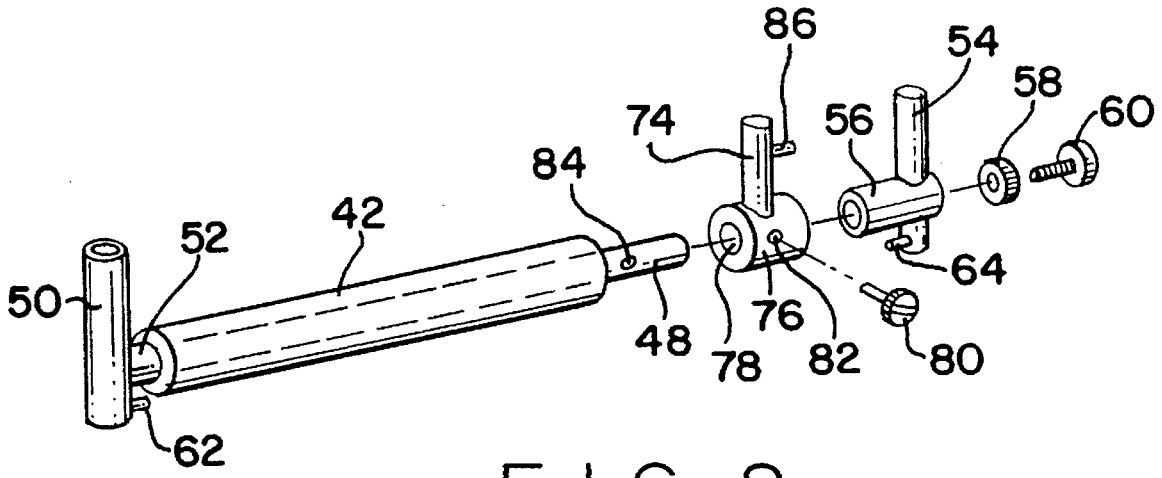
FIG. 2 is an exploded perspective view showing the mounting of the arm members.

Referring to the drawings, the exercise apparatus according to the present invention includes a frame formed from sections of rigid tubing, illustratively steel, which are bent and connected together so as to provide a base and a pair of spaced upright supports. The base includes a pair of horizontal sections 12, 14 which are adapted to be supported on a horizontal surface. Connected to the base sections 12, 14, illustratively by welding, is a vertically oriented U-shaped upright support including a lower horizontal section 16 extending between the base sections 12, 14 and a pair of spaced upright sections 18, 20. Mounted to the top of each of the upright sections 18, 20, as by welding or the like, is a short section of horizontal tubing 22, 24, respectively. Each of the sections 22, 24 supports a respective horizontal shaft (not shown) which are colinear with each other to define a first pivot axis.

The illustrated exercise apparatus also includes a pair of stride assemblies each mounted to the frame. The stride assemblies are adapted to support a user performing striding exercises between the pair of spaced upright support sections 18, 20. Each of the stride assemblies includes a respective one of the leg members 26, 28. The leg members 26, 28 are each formed from a length of rigid tubing material, illustratively steel, and are oriented generally vertically. The upper ends of the leg members 26, 28 are pivotally mounted to the frame via the respective first pivot axis shaft within the respective tubing sections 22, 24. Such mounting can have the shaft journalled for rotation within its respective tubing section 22, 24 with the respective leg member 26, 28 secured or journalled thereto. Alternatively, the shaft can be fixed in the tubing section or be an extension thereof, and the respective leg member 26, 28 can be Journalled for rotation on the shaft. At their lower ends, each of the leg members 26, 28 is bent into a general L-shape toward the other leg member 28, 26, where it has secured thereto a respective foot platform 30, 32 adapted to support a user thereon.

Figure 3:
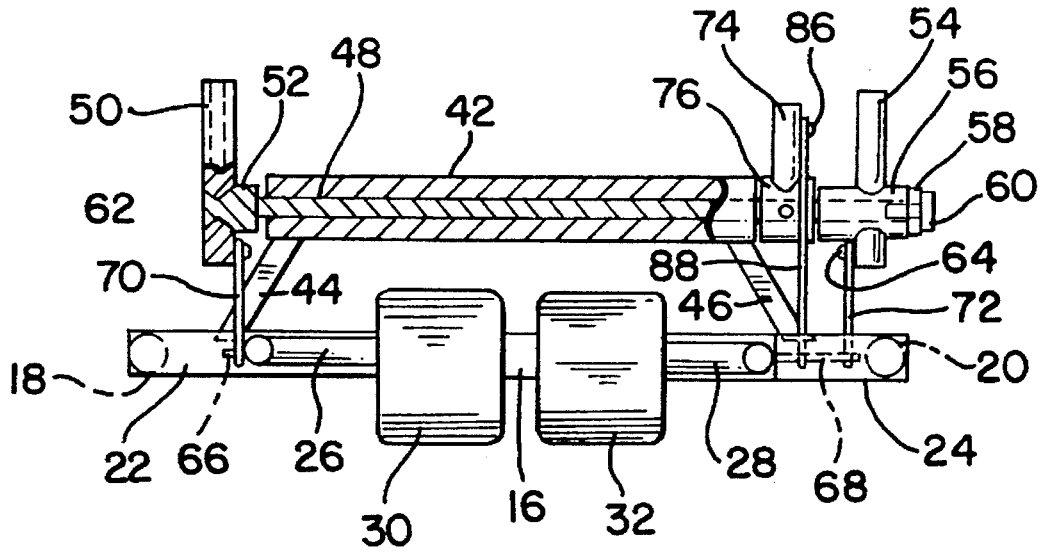
FIG. 3 is a partially sectioned and schematic top plan view of the exerciser shown in FIG. 1.

Each of the stride assemblies further includes a respective arm member 34, 36 having a respective hand grip 38, 40, which may be covered with a cushioning foam material, at its upper end. For supporting the arm members 34, 36, there is provided a hollow tube 42 fixedly secured to the frame in a horizontal orientation and forwardly of the upright support sections 18, 20. Such securement is illustratively by means of the rigid bars 44, 46. The bar 44 is welded at one end to the tube 42 and at the other end to the short tubing section 22. Likewise, the bar 46 is welded at one end to the tube 42 and at the other end to the short tubing section 24. A shaft 48 is journalled for rotation within the tube 42 in a conventional manner and defines a pivot axis for the arm members 34, 36. The arm member 34 is held at its lower end within a tube 50. The tube 50 is mounted to a stub 52 which is fixedly secured to one end of the shaft 48so that the arm member 34 extends transverse (preferably orthogonally) to the shaft 48. The arm member 36 is held at its lower end by the tube 54 which is secured to the stub 56. As best shown in FIG. 3, the stub 56 is hollow and acts as a bearing for the shaft 48 (the tube 54 having a transverse opening therethrough to allow the shaft 48 to pass therethrough). Thus, the stub 56 extends transversely (preferably orthogonally) to the tube 54 so that the arm member 36 is pivotally mounted to the shaft 48. The stub 56 is held on the shaft 48 by the washer 58 and bolt 60. Thus, the pivot axis for the arm members 34, 36 is horizontally displaced forward of, and parallel to, the pivot axis for the leg members 26, 28.

Figure 4:
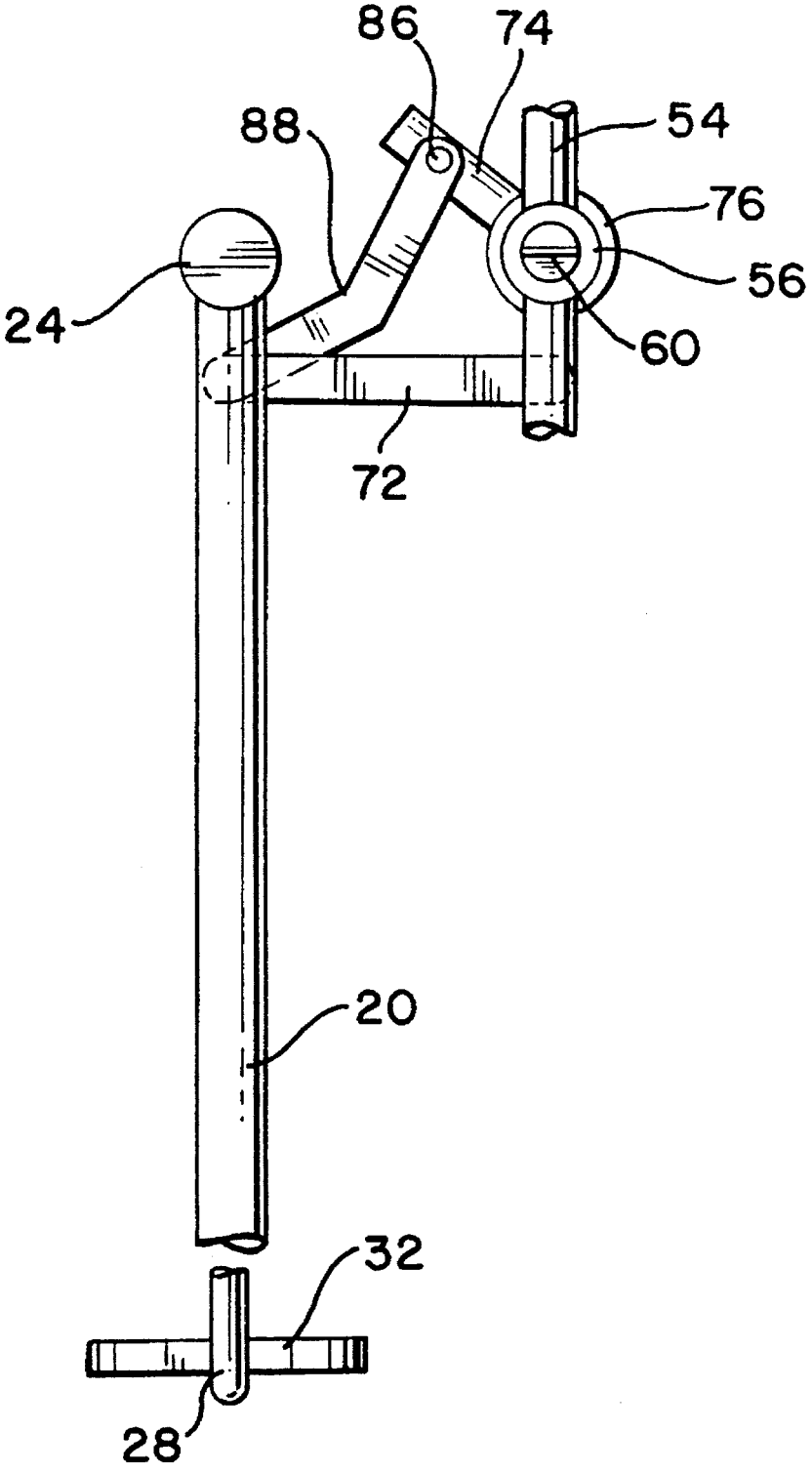
FIG. 4 is a schematic side view showing the linkages for the first and second interconnect means.

Within each of the stride assemblies, it is desired that the pair of arm and leg members pivot concurrently in the same angular direction about their respective pivot axes. To effect such movement, each of the tubes 50, 54 extends below the shaft 48 and has mounted thereon a respective pin 62, 64 parallel to the shaft 48. Each of the leg members 26, 28 has mounted thereon a respective pin 66, 68 parallel to and below the pivot axis for the respective leg member 26, 28. For each of the stride assemblies, there is provided a respective rigid link 70, 72 which is pivotally coupled at a first end to the respective leg members 26, 28 via the respective pin 66, 68 and is pivotally coupled at a second end to the respective arm member 34, 36 via the respective pin 62, 64. Thus, as the foot platform 32 is moved forwardly, the leg member 28 pivots in a counterclockwise direction (as viewed in FIG. 4) about its pivot axis and the link 72 is moved forwardly. This causes the tube 54 and the arm member 36 to also pivot in a-counterclockwise direction, moving the hand grip 40 rearwardly. Although in the disclosed apparatus, the tubes 50, 54 are shown extending below the pivot axis defined by the shaft 48, it is understood that alternatively the leg members 26, 28 could extend above their pivot axis. What is important is that the rigid links 70, 72 interconnecting the respective pairs of leg and arm members are pivotally coupled to the leg and arm members on the same side of their pivot axes (i.e., either above or below).

It is also desirable to interconnect the pair of stride assemblies for concurrent pivoting movement in opposite angular directions about the pivot axes, to conform with a person's striding movement. To provide such interconnection, a short rigid bar 74 is securely mounted to a bushing 76 having a bore 78 therethrough. The bushing 76 is mounted on the shaft 48, with the shaft 48 extending through the bore 78, and is secured to the shaft 48 for rotation therewith by means of the set screw 80 which extends through a transverse aperture 82 in the bushing 76 and is threaded into the internally threaded aperture 84 in the shaft 48. The bar 74 extends orthogonally to the shaft 48 and has mounted thereto a pin 86 which extends parallel to the shaft 48. A rigid link 88 is pivotally mounted at a first end to the leg member 28 via the pin 68 and is pivotally mounted at its second end to the bar 74 via the pin 86. As is clear from FIG. 4, the rigid link 88 is mounted to the leg member 28 below its pivot axis and is mounted to the bar 74 above the pivot axis of the arm member 34, to which the bar 74 is fixedly secured via the shaft 48. Thus, as the foot platform 32 is moved forwardly, the link 88 is also moved forwardly and moves the bar 74 forwardly, thereby moving the arm member 34 forwardly. This forward movement of the foot platform 32 corresponds to a pivoting, in the counterclockwise direction of the leg member 28 about its pivot axis and causes the arm member 34 to pivot in a clockwise direction about its pivot axis. Thus, the pair of stride assemblies are interconnected for concurrent pivoting movement in opposite angular directions about the pivot axes.

Accordingly, there has been disclosed an improved striding exerciser for effecting a non-impact aerobic workout of the user. It is understood that the above-described embodiment is merely illustrative of the application of the principles of this invention. Numerous other embodiments may be devised by those skilled in the art without departing from the spirit and scope of this invention, as defined by the appended claims.

What is claimed is:

1. Exercise apparatus comprising:

a frame having a base adapted to be supported on a horizontal surface and a pair of spaced upright supports each secured to and extending upwardly from said base;

a pair of stride assemblies each mounted to said frame, each of said stride assemblies including:

a leg member pivotally mounted to a respective frame support at a horizontal first pivot axis and extending below said first pivot axis between said pair of supports;

a foot platform mounted to said leg member at a location below and remote from said first pivot axis and adapted to support a user thereon;

an arm member pivotally mounted to said frame at a horizontal second pivot axis parallel to and spaced from said first pivot axis, said arm member extending above said second pivot axis;

a hand grip mounted to said arm member at a location above and remote from said second pivot axis; and first interconnect means for interconnecting said leg member and said arm member for concurrent pivoting movement in the same angular direction about their respective pivot axes; and second interconnect means for interconnecting said pair of stride assemblies for concurrent pivoting movement in opposite angular directions about the pivot axes.

2. The apparatus according to claim 1 wherein for each of said stride assemblies one of said arm and leg members includes an extension extending beyond the respective pivot axis and said first interconnect means includes a rigid link pivotally coupled to said extension and to the other of said arm and leg members.

3. The apparatus according to claim 2 wherein said arm member includes said extension and said rigid link is pivotally coupled below said first pivot axis to said leg member and below said second pivot axis to said extension.

4. The apparatus according to claim 1 wherein said second interconnect means includes:

a rigid bar coupled to the arm member of one of said stride assemblies for rotation therewith about the second pivot axis, said rigid bar extending above the second pivot axis; and a rigid link pivotally coupled above said second pivot axis to said rigid bar and below said first pivot axis to the leg member of the other stride assembly.

5. The apparatus according to claim 1 further including:

a hollow tube fixedly secured to said frame in a horizontal orientation;

a shaft journalled for rotation in said tube and defining said second pivot axis;

means for fixedly securing one of said arm members to said shaft at one end of said tube; and means for rotatably mounting the other of said arm members on said shaft at the other end of said tube;

wherein said second interconnect means includes:

a rigid bar fixedly mounted to said shaft at the other end of said tube; and a rigid link pivotally coupled above said second pivot axis to said rigid bar and below said first pivot axis to the leg member in the same stride assembly as said other arm member.

6. The apparatus according to claim 5 wherein for each of said stride assemblies one of said arm and leg members includes an extension extending beyond the respective pivot axis and said first interconnect means includes a second rigid link pivotally coupled to said extension and to the other of said arm and leg members.

7. Exercise apparatus comprising:

a frame including a base adapted to be supported on a horizontal surface and first and second spaced upright support members;

first and second leg members respectively pivotably mounted to said first and second support members at a first pivot axis and extending downwardly therefrom, said first and second leg members each being operative for reciprocating movement between said support members, said first and second leg members each including a platform below said first pivot axis for supporting a user in an upright position between said leg members;

first and second arm members respectively pivotably mounted to said frame at a second pivot axis which is horizontally displaced from said first pivot axis, said arm members each extending upwardly from said second pivot axis and being operative for reciprocating movement, said arm members each being associated with a respective one of said first and second leg members on a respective side of the user, said arm members each including a respective hand grip remote from said second pivot axis;

first and second interconnect means each for interconnecting a respective associated pair of leg and arm members for concurrent pivoting movement in the same angular direction about the first and second pivot axes, respectively; and third interconnect means for interconnecting the pairs of leg and arm members for concurrent pivoting movement in opposite angular directions.

8. The apparatus according to claim 7 further including:

a hollow tube fixedly secured to said frame in a horizontal orientation;

a shaft journalled for rotation in said tube and defining said second pivot axis;

means for fixedly securing said first arm member to said shaft at a first end of said tube; and means for rotatably mounting said second arm member on said shaft at the second end of said tube;

wherein said third interconnect means includes:

a rigid bar fixedly mounted to said shaft at said second end of said tube; and a rigid link pivotally coupled above said second pivot axis to said rigid bar and below said first pivot axis to the leg member associated with said second arm member.

9. The apparatus according to claim 8 wherein for each of said associated pairs of leg and arm members one of said leg and arm members includes an extension extending beyond the respective pivot axis and said first and second interconnect means each includes a respective rigid link pivotally coupled to said extension and to the other of said leg and arm members.

* * * * *